US010383381B2

(12) United States Patent
Price

(10) Patent No.: US 10,383,381 B2
(45) Date of Patent: Aug. 20, 2019

(54) GLOVE

(71) Applicant: Joel F. Price, Chevy Chase, MD (US)

(72) Inventor: Joel F. Price, Chevy Chase, MD (US)

( * ) Notice: Subject to any disclaimer, the term of this patent is extended or adjusted under 35 U.S.C. 154(b) by 135 days.

(21) Appl. No.: 15/647,906

(22) Filed: Jul. 12, 2017

(65) Prior Publication Data

US 2019/0014838 A1 Jan. 17, 2019

(51) Int. Cl.

| | |
|---|---|
| ***A41D 19/015*** | (2006.01) |
| ***A63B 71/14*** | (2006.01) |
| ***A41D 27/28*** | (2006.01) |
| *A41D 19/00* | (2006.01) |
| *A63B 71/00* | (2006.01) |

(52) U.S. Cl.

CPC . *A41D 19/01547* (2013.01); *A41D 19/01558* (2013.01); *A41D 27/28* (2013.01); *A63B 71/141* (2013.01); *A41D 19/00* (2013.01); *A63B 71/00* (2013.01)

(58) Field of Classification Search

CPC ..... A41D 19/01547; A41D 19/01576; A41D 19/01558; A41D 19/02; A63B 71/141; A63B 71/146

USPC ..... 2/159, 161.2

See application file for complete search history.

(56) References Cited

U.S. PATENT DOCUMENTS 889,397 A * 6/1908 O'Shaugnessy ..... A41D 19/00 2/159
1,149,139 A * 8/1915 Heagle ..... A41D 19/00 2/159
1,885,572 A 11/1932 Wood
2,242,318 A 5/1941 Mosier
2,309,476 A * 1/1943 Patterson, Jr. ..... A63B 71/146 2/159
2,309,710 A 2/1943 Patterson, Jr.
2,559,788 A 7/1951 Patterson
2,657,391 A 11/1953 Crandon
2,703,887 A 3/1955 Kennedy
2,907,047 A * 10/1959 Steinberg ..... A63B 71/146 2/161.2
2,913,729 A 11/1959 Wisenburg
2,949,610 A 8/1960 Lutsky
3,273,165 A * 9/1966 Sperandeo ..... A63B 71/146 2/169
3,341,861 A 9/1967 Robbins
3,363,265 A 1/1968 Dummire
3,430,265 A * 3/1969 Mazza ..... A41D 19/02 2/162
3,649,967 A 3/1972 Millman
4,195,365 A 4/1980 Eyman et al.
4,316,926 A 2/1982 Kaminstein
4,416,026 A * 11/1983 Smith ..... A41D 19/0013 2/161.6
4,497,072 A 2/1985 Watanabe et al.
4,514,460 A 4/1985 Johnson
5,761,745 A * 6/1998 Sato ..... A63B 71/146 2/159
5,774,895 A 7/1998 Baldwin
5,794,266 A 8/1998 Han
(Continued)

*Primary Examiner* — Alissa L Hoey
(74) *Attorney, Agent, or Firm* — Andrew M. Calderon; Roberts Mlotkowski Safran Cole & Calderon, P.C.

(57) ABSTRACT

The present disclosure generally relates to a glove and, more particularly, to a conformal glove which retains tactile sensitivity and increases overall handgrip of the user, in addition to maintaining manual dexterity and maximizing air ventilation.

21 Claims, 4 Drawing Sheets

(56) References Cited

U.S. PATENT DOCUMENTS 5,829,061 A * 11/1998 Visgil ..... A41D 19/0013 2/161.6
5,855,022 A * 1/1999 Storto ..... A63B 71/146 2/161.2
5,926,847 A * 7/1999 Eibert ..... A63B 71/146 2/161.2
5,983,395 A 11/1999 Lei
5,991,926 A 11/1999 Lakusiewicz
6,035,444 A * 3/2000 McGrew ..... A41D 19/0017 2/16
6,041,438 A 3/2000 Kirkwood
6,154,885 A 12/2000 Kobayashi et al.
6,254,947 B1 7/2001 Schaller
6,408,442 B1 6/2002 Kang
6,427,247 B1 * 8/2002 Suk ..... A63B 71/146 2/159
6,526,593 B2 3/2003 Sajovic
D478,405 S 8/2003 Hatcher et al.
6,675,392 B2 1/2004 Albert
6,832,391 B1 12/2004 Bower
6,912,731 B2 7/2005 Cass
7,487,553 B2 2/2009 Price
7,707,653 B2 * 5/2010 Kleinert ..... A41D 19/015 2/161.1
7,895,670 B2 * 3/2011 Kleinert ..... A41D 19/01582 2/161.1
9,538,797 B2 * 1/2017 Jones ..... A41D 19/0013
2002/0042940 A1 * 4/2002 Kuroda ..... A41D 19/01582 2/161.1
2005/0034213 A1 * 2/2005 Bamber ..... A41F 1/06 2/161.1
2006/0179539 A1 * 8/2006 Harber ..... A41D 13/002 2/69
2006/0212990 A1 * 9/2006 Mattesky ..... A41D 19/0006 2/161.6
2007/0150998 A1 * 7/2007 Atherton ..... A41D 19/01505 2/159
2007/0245455 A1 * 10/2007 Robba ..... A63B 71/146 2/161.6
2008/0072358 A1 * 3/2008 Kleinert ..... A41D 19/015 2/21
2008/0109934 A1 * 5/2008 Widdemer ..... A41D 19/01523 2/159
2009/0313742 A1 * 12/2009 Smeltzer ..... A41D 27/28 2/161.2
2010/0186142 A1 * 7/2010 Kume ..... A41D 19/01564 2/161.1
2011/0296582 A1 * 12/2011 Bevier ..... A41D 19/01547 2/161.1
2013/0061369 A1 * 3/2013 Lim ..... A63B 71/146 2/161.2
2013/0191961 A1 * 8/2013 Litke ..... A63B 71/146 2/161.2
2013/0263354 A1 * 10/2013 Gibby ..... A63B 71/14 2/161.1
2014/0041095 A1 * 2/2014 Cynn ..... A41D 19/01558 2/161.2
2016/0101342 A1 * 4/2016 Iacono ..... A63B 71/146 2/161.2
2016/0366963 A1 * 12/2016 Koshkaroff ..... A41D 27/28
2017/0028669 A1 * 2/2017 Regester ..... B32B 3/266
2017/0071275 A1 * 3/2017 Darby ..... A41B 1/08
2017/0113117 A1 * 4/2017 Dunlap ..... A63B 71/146

* cited by examiner

GLOVE

FIELD OF THE INVENTION

The present invention generally relates to a glove and, more particularly, to a conformal glove which provides improved tactile sensitivity and increased overall handgrip of the user, in addition to maintaining manual dexterity and maximizing air ventilation.

BACKGROUND

Individuals participating in strenuous sport or work activities all have a common problem, i.e., the degrading ability to grip objects as their hands perspire or become wet. Most choose to address the problem by wearing one of the numerous hand gloves available on the market. However, in all the grip gloves available today, the wearer in varying degrees sacrifices tactile sensitivity and overall hand dexterity for improved grip, especially when wet.

More specifically, conventional grip gloves intended for sports or work activities are made from materials that inherently sacrifice both tactile sensitivity and manual dexterity to achieve the desired grip improvement. These conventional type gloves also do not tend to freely permit the escape of moisture and heat, thereby increasing overall perspiration that leads to even further loss of grip. Most importantly, these conventional types of grip gloves sacrifice tactile sensitivity in order to gain improved grip.

SUMMARY

In an aspect of the disclosure, a glove, comprises: a front side and a backside corresponding to a palm area and backside of a user's hand, respectively; a plurality of independently extending tubular members extending from the palm area, the plurality of independently extending tubular members including four extending tubular members and an opposing extending tubular member; and a plurality of inter-dispersed holes throughout the backside and the front side, including the independently extending tubular members and the palm area, wherein: the plurality of inter-dispersed holes include first sized holes, second sized holes and third sized holes; the first sized holes are larger than the second sized holes and the second sized holes are larger than the third sized holes, each of which are positioned to prevent pass through of a user's fingers during donning and wearing of the glove; the third sized holes are provided at tips and foldable areas of the plurality of independently extending tubular members, on the front side, including at a junction of the plurality of independently extending tubular members and the palm area; the second sized holes are positioned above an upper most foldable area of the four tubular members, directly below the third sized holes provided at the tips; and a first of the first sized holes is positioned above an upper most foldable area of the opposing tubular member, below the second sized holes provided at the tip.

In an aspect of the disclosure, a glove comprises a front portion defining a palm area, a rear portion, a plurality of independent tubular members extending from the palm area which includes a central portion and a perimeter portion, and a plurality of inter-dispersed holes provided through at least the central portion the palm area and the plurality of independent tubular members to maximize tactile sensation, increase flexibility and conformity to a user's hand, the plurality of inter-dispersed holes are each substantially circular shaped configured; and further comprising: a composite material that exhibits greater stretchable characteristics in a first direction than in a second direction; a second material which anchors the composite material; and wherein an overall thickness of the glove in the palm area and the plurality of independent tubular members is approximately is approximately 0.023 inches.

BRIEF DESCRIPTION OF THE DRAWINGS

The present disclosure is described in the detailed description which follows, in reference to the noted plurality of drawings by way of non-limiting examples of exemplary embodiments of the present disclosure.

DETAILED DESCRIPTION

Figures 1A, 1B:
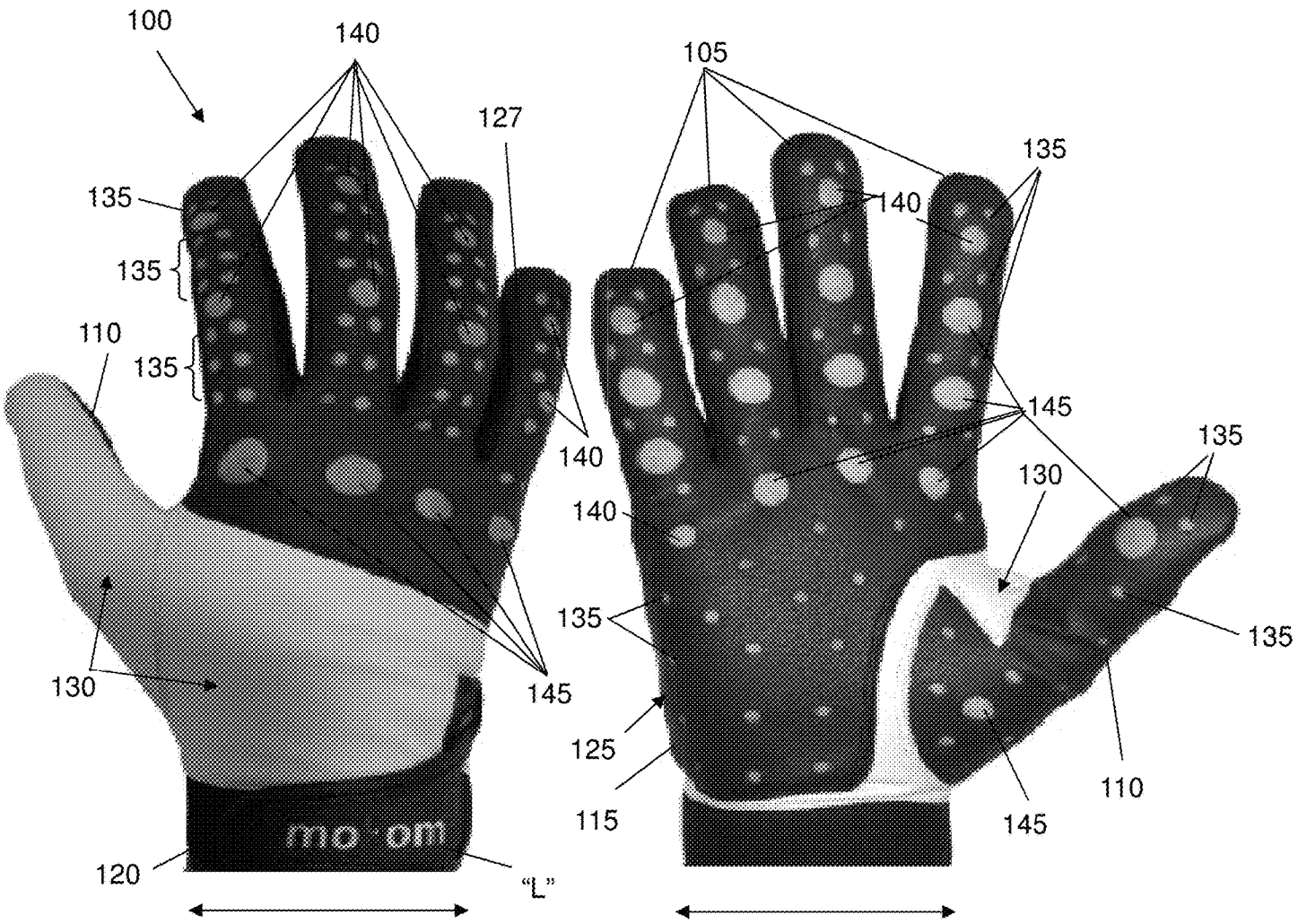
FIGS. 1A and 1B show a front side and a backside, respectively, of a glove in accordance with aspects of the present disclosure.

The present invention generally relates to a glove and, more particularly, to a conformal glove which provides improved tactile sensitivity and increased overall handgrip of the user, in addition to maintaining manual dexterity and increasing air ventilation. In embodiments, the glove(s) described herein can be used for various sporting activities that benefit from increased tactile sensitivity and overall handgrip, e.g., golf, baseball, football, and racquet (racket) sports, etc. Advantageously, the glove described herein maximizes tactile sensitivity by placing the actual skin and nerves of the user's hand on the held object. Also, the glove configuration is made to optimize the balance between natural tactile sensitivity and hi-tech grip while still maintaining manual dexterity and maximizing air ventilation.

The present disclosure addresses many unexpected issues found with known prior art gloves including, e.g., U.S. Pat. No. 7,487,553. Note that U.S. Pat. No. 7,487,553 and the present inventor have the same inventorship. Specifically, during extensive field testing of the glove disclosed in U.S. Pat. No. 7,487,553 the inventor found several limitations of such glove which were not previously recognized and which are now addressed and improved upon by the glove described herein. For example, the diameter and pattern of the holes of the glove in U.S. Pat. No. 7,487,553 have been found to have the following limitations:

(i) it is difficult to don (e.g., put on) the glove, e.g., the user's fingers easily get caught on the larger diameter holes and, in some cases, the user's fingers even pass through such holes when donning the glove;

(ii) when wearing the glove, the user's fingers could pass through the holes located at the tip of the fingers during certain activities;

(iii) excess skin exposure of approximately 60-75% weakens the overall material strength of the glove, particularly between the holes that are placed too close together and at high stress and wear areas such as the palms; and (iv) the manual dexterity of the user's wrist is limited in certain applications mainly due to the placement of the glove closure location within the glove (compared to the alternative glove closure options described herein).

In addition, the material, e.g., Neoprene, used in making the more disposable glove disclosed in U.S. Pat. No. 7,487,553 was specifically contemplated due to its supposed ease of manufacturability and ability to place the holes in the specific arrangement described in such patent. Upon further exploration of both the manufacturing processes required and field testing of the gloves, though, it has been found that the envisioned glove form dip molding and hole cutting processes were more complicated than anticipated. In addition, the excessive 60-75% skin exposure was deemed insufficiently durable for a longer lasting grip glove. These and the other issues have been addressed by the improvements to the glove disclosed herein.

After extensive testing and experimentation, it has been found by the inventor that there are many tradeoffs between the size and pattern of the holes of the glove while still trying to achieve improved tactile sensitivity, increased overall handgrip, maintained manual dexterity and maximized air ventilation for a more durable glove. By taking all of these factors into consideration, the gloves described herein provide the following desirable and improved features, amongst other features.

Improved Overall Handgrip

The glove is composed of material that improves the overall friction performance of the glove, e.g., makes the glove tacky for improved grip, even in wet conditions, while conforming directly to the user's hand. The material in combination with the size and pattern of holes also permits improved, natural hand closure, which provides improved dexterity as described herein.

By way of specific example, the glove disclosed herein is composed of a composite material of polyester knit fabric (with more stretch in a single direction) and polyurethane coating (for grip), attached to a less stretchable material, e.g., leather. It has been found that the ideal ratio of polyester to polyurethane is approximately 60% polyester and 40% polyurethane, which when based on the proper knit pattern and grip coating provides improved stretchability in a single direction (e.g., in the horizontal direction), while limiting the stretchability in the other direction (e.g., in the vertical direction along an axis of the fingers and palm area).

The less stretchable material, e.g., leather, advantageously provides an anchor point for the more stretchable polyester/polyurethane knit fabric. This anchor point will provide improved stretchability characteristics of the polyester/polyurethane knit fabric across the palm and other hand features. Additional breathable material such as Rayon or other similar materials within the fourchette (e.g., between the fingers) is also contemplated, with leather wear pads on the palm for certain sports, e.g., golf or racquet sports.

Improved Manual Dexterity

By using the specific materials described herein and the pattern and sized holes, the glove provides significantly improved natural unrestrictive motion of the palm, fingers and thumb. By way of example, the holes are sized and located to eliminate or minimize material in areas where natural hand motion could be restricted, such as knuckles and creases of both the palm and fingers. In addition, as described herein, different sized holes will be provided at the creases, compared to the knuckles, to ensure that the material strength is maintained between the holes (e.g., enough material is maintained between the holes to withstand the stresses imposed on the glove during normal sport or work activities).

In embodiments, the specific polyester/polyurethane knit fabric selected also has other benefits in that the thickness of the material can be significantly less than other grip gloves in the market. Specifically, the thickness of the glove described herein can be approximately 0.023 inches as compared to other sport grip gloves that consist of polyurethane coated or other proprietary high tack coatings on leather or other fabrics that are approximately 50-65% thicker at 0.035 to 0.038 inches (e.g. football receiver grip gloves). The difference in thickness provides a significant improvement in both tactile sensitivity the manual dexterity of the user, which then also leads to an increase in the overall handgrip and the potential use in more applications, especially, those that truly value the balance of tactile sensitivity and improved handgrip (e.g. quarterbacks, special team players, golfers, baseball fielders, etc.)

Improved Tactile Sensitivity

The placement of the larger sized holes will coincide with the padded areas of the fingers, palm and thumb which have more tactile sensitivity than any other areas of the hand. For example, the largest sized holes, as described herein, will be located at the mid and bottom portion of the fingers, in addition to the base of the fingers at the padding of the palm. The medium sized holes, on the other hand, will be located at the fingertips. This pattern or arrangement of holes will maximize the tactile feel of the user, while also ensuring that the user's fingers will not pass through the holes (e.g., pop out) when donning and wearing the glove. Also, this pattern or arrangement of holes will maximize the percentage of skin contact to maintain overall tactile sensitivity, but still maintaining the material strength of the glove. The dramatic increase of tactile sensitivity in a grip glove opens up new applications and market possibilities. For example, a golfer may now choose to keep his glove on while putting on a hot summer day, or a football quarterback, tennis player or baseball fielder may now wear a grip glove without sacrificing the necessary sensitive touch required for their particular sport.

Increased Ventilation

The pattern or arrangement of holes, small, medium and largest, has been maximized to allow for maximum ventilation, while maintaining improved tactile sensitivity and manual dexterity and still preventing the fingers from passing through the holes.

FIGS. 1A and 1B show a front side and a backside, respectively, of a glove in accordance with aspects of the present disclosure. It should be understood by those or ordinary skill in the art that the front side and a backside corresponding to a palm and backside of a user's hand, respectively. In embodiments, the glove 100 is preferably fully anatomical, i.e., including finger stall 105, an opposing thumb 110 and a palm area 115. The fingers 105 and opposing thumb 110 are tubular members, attached to the body of the glove, e.g., palm area 115. An elastic wristband 120 is also provided on the glove 100. In embodiments, the elastic wristband 120 has a straight cuff, although other cuffs are also contemplated herein (see, e.g., FIG. 2B). The elastic wristband 120 also includes a fastening device 123, e.g., Velcro™, on a front side, for ease of donning and fastening to the user's hand, respectively.

A logo "L" may be sewn or otherwise attached to a rear side of the glove 100, and preferably the wristband 120. The gloves 100 may be sewn with double stitching, for example, and the hole pattern as described herein may be produced using laser cutting technologies (or manual or thermal hole punch processes). The laser cutting process also helps to melt both the polyurethane coated polyester knit fabric around the hole perimeter for reduced thread fraying and increased durability. The sewn fabrication of the gloves 100 from multiple flat pattern materials also simplified the manufacturing of the gloves from the previous glove envisioned in U.S. Pat. No. 7,487,553. The gloves 100 may also be manufactured in multiple sizes, each of which would have the same characteristics as described herein.

In embodiments, the glove 100 is composed of materials including textured polyurethane coated polyester knit fabric (or similar stretch material—more stretch in one direction) (e.g., approximately 60% polyester and 40% polyurethane) designated at reference numeral 125, attached to a less stretchable material 130, e.g., leather.

As shown in FIGS. 1A and 1B, the fingers 105, the thumb 110, the palm area 115 and a partial back area (i.e., crossing over at least the knuckles) are composed of the polyurethane coated polyester knit fabric 125, with the remaining portion of the glove 100 being of a less stretchable material 130 (including the backside of the thumb 110). More specifically, the less stretchable material 130 is provided about a base of the thumb 110 and above the wrist area, e.g., wristband 120, in addition to the complete backside of the thumbs and palm area. The fourchette 127 (e.g., material between the fingers) is composed of Rayon or other breathable and stretchable material (preferably different from the other materials). This combination of materials will provide improved stretchability and conformability characteristics across the palm 115 along a single direction (e.g., see arrow in the horizontal direction) and other hand features. In alternative embodiments, the glove 100 may be composed of different material at the top back of the hand, without any holes. This material may be a lightweight, stretchable, breathable material, e.g., tight mesh material. It is also contemplated that the glove 100 may be composed of another hi-tack "grippy" material on the inside of glove (front side of the glove) such as, e.g., textured silicone coating.

Still referring to FIGS. 1A and 1B, the glove 100 includes inter-dispersed holes of three different sizes, e.g., hole 135, hole 140, and hole 145, strategically placed in different locations to retain tactile sensitivity, increase overall handgrip, maintain manual dexterity, and maximize air ventilation. The shape of the holes are preferably circular to allow the glove 100 to conform, flatly, to the complex shape of a user's hand. The circular shape may also provide improved roll over capabilities (compared to other shapes), which improves gripping capabilities of the user. In addition, a circular shape minimizes tear points, e.g., does not possess stress points at corners. In embodiments, the holes can provide an overall skin exposure of approximately 5-30% and more preferably 10-15% (on the inside (front side) of the glove), e.g., approximately 15-30% on four fingers, 10% on thumb, 5% on palm) on the inside of the glove; although these percentages can vary proportionally more or less depending upon glove size. In embodiments, the holes 135 are ⅛ inch in diameter, the holes 140 are ¼ inch in diameter, and the holes 145 are ⅜ inch in diameter.

On the front side of the glove, e.g., FIG. 1A, the smallest sized holes 135 are strategically placed for both ventilation as well as to increase the manual dexterity of the user. Specifically, as to the latter feature, the holes 135 are placed strategically, e.g., fold areas of the glove corresponding to the creases of fingers 105, thumb 110 and palm 115 to eliminate or minimize material in areas where natural hand motion could be restricted, thereby increasing the natural unrestrictive motion of the palm, fingers and thumb and hence the manual dexterity of the user. The holes 135 at the tip of the fingers 105 and thumb 110, on the front side of the glove 100, as well as the holes 135 on the backside of the glove, e.g., FIG. 1B, will also provide additional ventilation. On both the front side and backside of the glove 100, the holes 135 can be provided in pairs. On the backside of the glove 100 (shown in FIG. 1B), the holes 135 can be provided in groups of three, alternating with the holes 140 provided at locations corresponding to the knuckles (foldable areas) of the fingers 105.

It is also important to note that the size and placement of the holes 135 provide many unexpected advantages, compared to the glove disclosed in U.S. Pat. No. 7,487,553. These advantages have been found after extensive field testing by the inventor. For example, it is noteworthy that the palm area 115 includes fewer smaller holes 135 than in U.S. Pat. No. 7,487,553. In addition, unlike that of U.S. Pat. No. 7,487,553, there are no larger holes inter-dispersed throughout the palm area (as this was found to weaken the material strength of the glove and facilitate the fingers passing through such larger holes during the donning of the glove). Moreover, the smaller holes are more evenly dispersed throughout the palm area since there is no additional material in the palm area (as shown in FIG. 3*a* of U.S. Pat. No. 7,487,553). This latter feature will provide improved ventilation, durability and manual dexterity to the user (as the additional material can be dramatically reduced).

By these arrangements, the size and placement of the holes 135 will prevent the user's fingers from passing through the holes, whether it be while the user is donning the glove 100 or wearing the glove 100 during a sporting or work activity. In addition, the size and placement of the holes 135 increases the material strength of the glove 100, as well as allows improved stretchability of the glove 100, itself. For example, the size and placement of the holes 135 on both the front side and backside allow more material to be provided between the holes 135, hence providing improved wearability and strength (as more material can be provided between the holes 135). In addition, the holes 135 along the front side and backside of the fingers 105 are provided in pairs so as to not consume too much material, hence maintaining the material strength and elasticity of the glove 100 In embodiments, the center distances: 1) between pairs of small holes 135 on the finger stalls are approximately ¼ inch; 2) between fingertip pair of small holes 135 and top fingertip medium holes 140 are approximately 5⁄16 inch; 3) between small holes on palm area varies from approximately ⅜ and 1 inch depending upon both location and glove size. The holes 135 at the fingertips of each of the fingers 105 and the thumb 110 will improve overall handgrip (due to increased friction from hole edges) and air ventilation (perspiration escape), with the understanding that they are strategically placed and sized so that the fingers will not pass through.

In addition, the size of the holes 135 prevent the fingers from catching on objects or the material around the holes 135 from rolling, hence preventing premature tearing or other wear of the glove 100. Moreover, as the placement of the holes 135 are specifically designed to coincide with the creases of the fingers 105, thumb 110 and palm 115, i.e., foldable areas of the glove, the manual dexterity of the user, being unrestricted, is greatly improved over the glove disclosed in U.S. Pat. No. 7,487,553. The holes 135 provided in the palm 115 (at the foldable areas corresponding with the creases of the user's palm) also increase the material in this area, resulting in increased grip and material strength, while still providing ventilation. In fact, it is preferred that only holes 135 are provided in the palm (below the padding of the hand, which includes holes 140, 145 as described herein) to increase material and grip. It has also been found that larger sized holes are not required in this palm area as: (i) increased tactile sensitivity is not required as much in this central area of the hand, (ii) durability and material strength of the glove significantly decreases and (iii) donning of the gloves is more difficult (compared to smaller sized holes).

Still referring to FIGS. 1A and 1B, the mid-sized holes 140 are strategically located to maximize tactile sensitivity of the user while also addressing many of the limitations of known gloves, e.g., the glove disclosed in U.S. Pat. No. 7,487,553. For example, referring to FIG. 1A, the holes 140 on the front side of the glove 100 are strategically placed at the tips (pads) of each finger 105 and the base of the thumb 110 and pinky where the most sensitive nerves reside on the hand. These holes 140 are strategically placed to maximize the tactile sensitivity at the fingertips, while still preventing the user's fingers (and thumb) from passing through the holes whether it be while the user is donning the glove 100 or wearing the glove 100 during a sporting activity.

As further shown in FIG. 1B, on the backside of the glove 100, the holes 140 are placed at the knuckles (foldable areas) to increase the flexibility and manual dexterity of the glove 100. The placement of the holes 140 at the knuckles also prevents the fingers from protruding from the holes or being caught by the edges during the donning and use of the glove 100 (compared to the use of larger sized holes). The holes 140 also increase ventilation. The holes 140 on backside will correspond in position with the holes 135 on the front side. Also, the holes 135 on the backside will correspond in position with the holes 140 and 145 on the front side.

It is of importance to note that the use of the mid-sized holes 140 at the fingertips and other sensitive areas (e.g., padded areas) of the hand is counterintuitive and provides many unexpected results. Specifically, one or ordinary skill in the art would intuitively use the largest holes at the fingertips and other sensitive areas of the hand in order to maximize tactile sensitivity. However, by using the largest openings in such areas, the inventor has found that donning the glove becomes more difficult as the user's fingers tend to be caught on the edges of the holes, as well as poke through the holes. In addition, it has been found, particularly at the fingertips, that the fingers tend to pass through the holes during use. These issues are now solved by the strategic placement of the mid-sized holes 140. In addition, it has been found that only minimal, if any, tactile sensitivity has been lost by using the mid-sized holes 140, something that does not significantly, if at all, affect the performance of the glove 100. In fact, it has unexpectedly been found by the inventor that hand grip is actually increased by using the smaller holes 140 since there is more material contact with the sporting equipment, hence increasing the overall handgrip on the held item.

FIG. 1A further show the largest holes 145 strategically placed along the fingers 105, between the holes 135 (and adjacent to but not over the creases of the fingers or thumb). In this arrangement, the largest holes 145 are provided at sensitive areas of the fingers 105, between the creases, which have higher tactile sensitivity. The largest holes 145 are also provided at the junction of the palms 130 and base of the fingers 105 and thumb 110. However, the midsized holes 140 is provided at the base of the pinky to ensure that the smaller pinky cannot protrude from the hole when donning the glove. On the backside, the largest holes 145 are provided on the larger knuckles to increase the flexibility and manual dexterity of the user. The strategic placement of the largest holes 145 also improves air ventilation of the glove, while not showing the limitations of the glove disclosed in U.S. Pat. No. 7,487,553.

The hole 145 is also placed at the tip (pad) of the thumb 110, between the holes 135. Those of ordinary skill in the art should understand that as the thumb 110 is larger than the other fingers 105, the largest hole 145 can be placed at the tip of the thumb 110 to improve or increase tactile sensitivity, without any concern for the thumb 110 passing therethrough during the donning and wearing of the glove 100. In embodiments, some applications (e.g., golf driving) wear more on the glove at the tip of the thumb and may require a smaller hole at that location. In embodiments, it has been found advantageous to sacrifice a little tactile sensitivity for more glove durability.

It is also contemplated that holes can be placed on the backside of the glove on the less stretchable (leather) material of the thumb 110 and lower hand material for more air ventilation and knuckle dexterity as shown representatively at reference numeral 155. These holes can be of varying diameter and preferably the knuckle hole on the thumb 110 would be of the larger sized hole (e.g., hole 145); whereas, the holes on the backside of the hand would be a smaller sized hole (e.g., hole 135). This arrangement will also ensure that the glove can be easily donned without the user's fingers protruding therefrom.

Figure 2A:
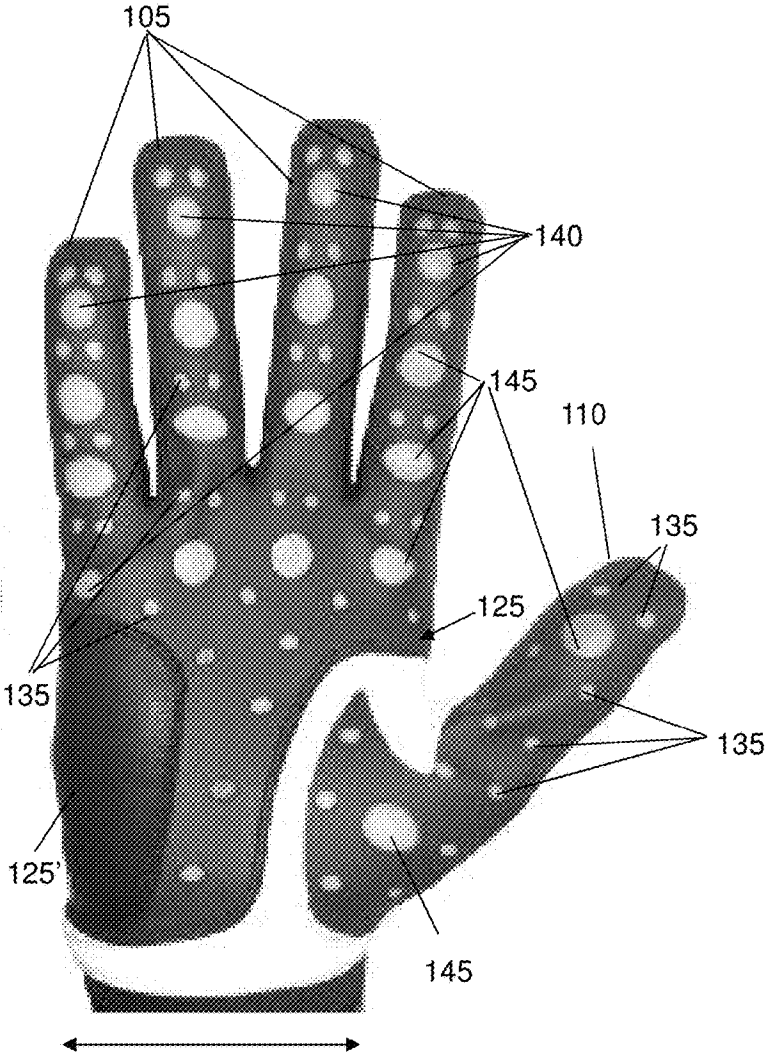
FIGS. 2A and 2B show a front side and a backside of a glove, respectively, in accordance with an additional aspect of the present disclosure.
Figure 2B:
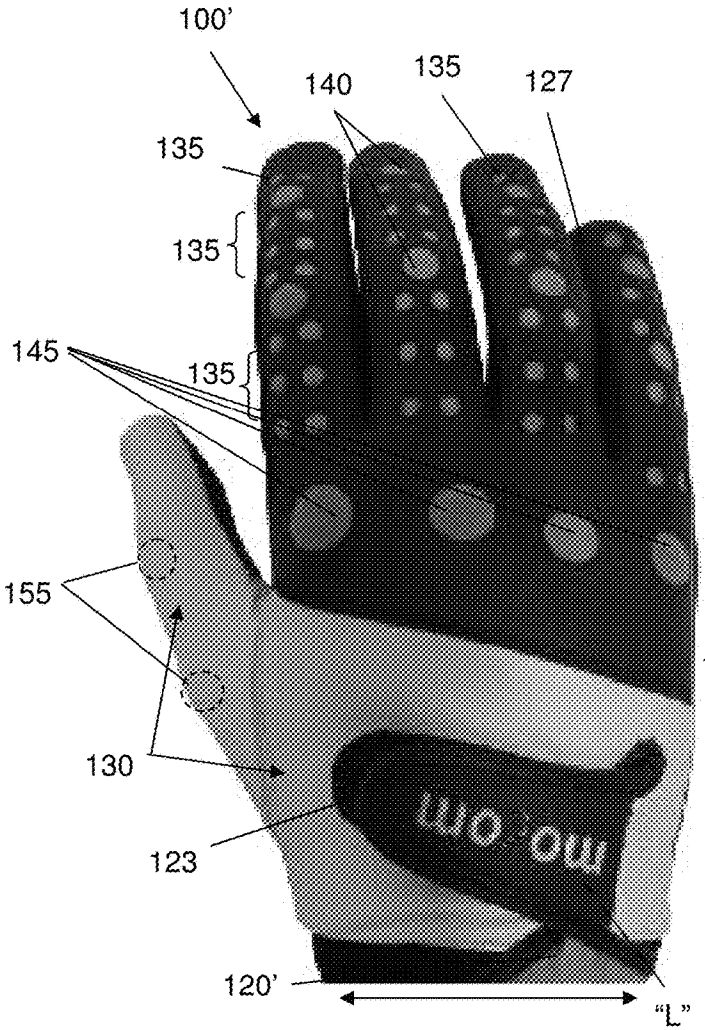

FIGS. 2A and 2B show a front side and a backside, respectively, of a glove in accordance with additional aspects of the present disclosure. In this embodiment, the glove 100' additionally includes a wear pad in the palm area 125', at a location opposing the thumb 110. In embodiments, the smooth or textured grip wear pad 125' can be leather or other durable material. The material 125' may be used for added hand protection (e.g., prevention of callouses), and to increase the durability of the glove such as the area between the thumb and remaining fingers preferably for use in golf and other racquet sports (and other envisioned work activities). In addition, the elastic wristband 120 can include a V-shape 120' on a backside of the wrist so as to not interfere with wrist motion during certain sporting activities, e.g., golf and racquet sports. The wristband 120 also includes a fastening device 123, e.g., Velcro™, on a backside side, for ease of donning and fastening to the user's hand, respectively. The remaining hole sizes and patterns are similar to that described with respect to FIGS. 1A and 1B.

Figure 3:
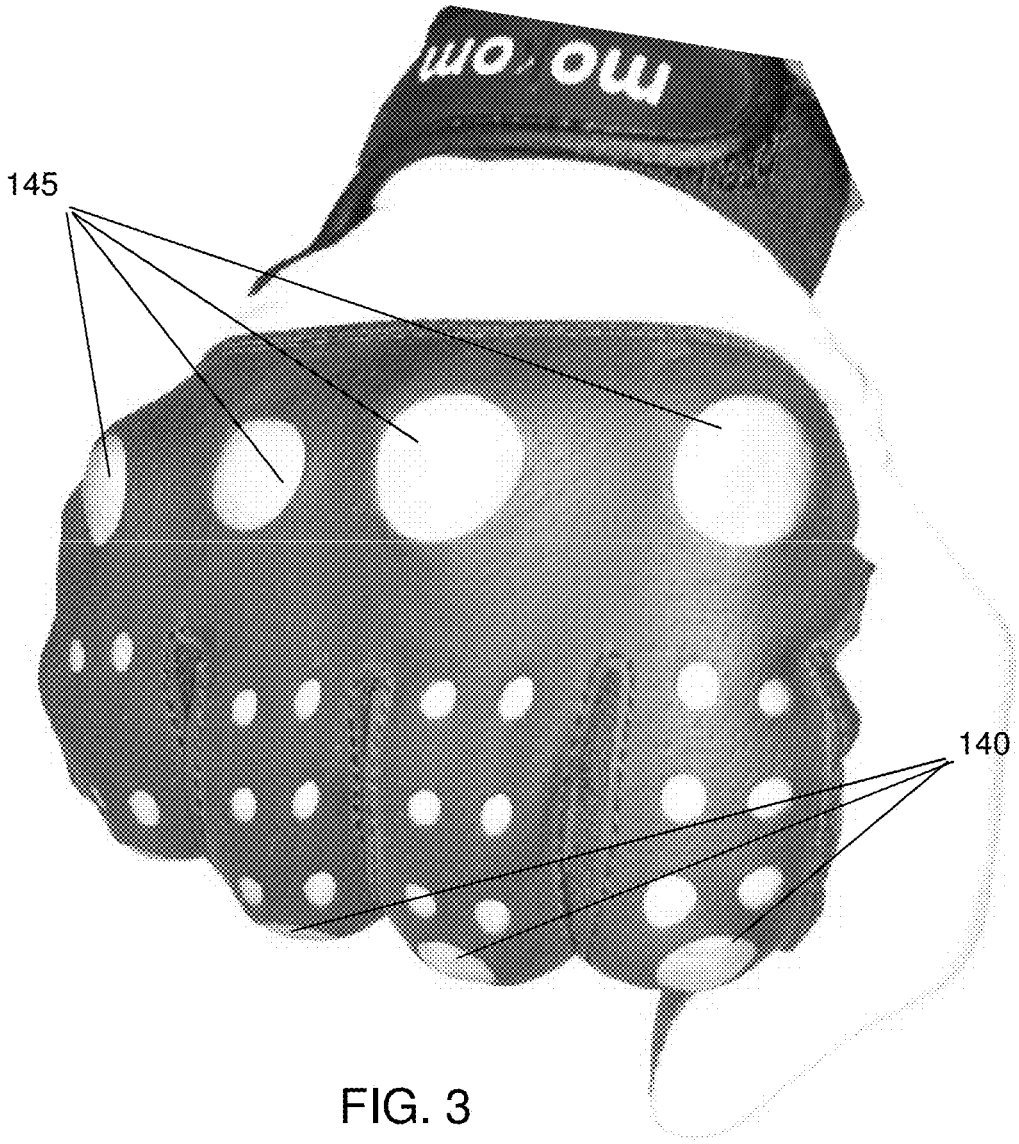
FIG. 3 shows the glove 100 with holes strategically place on the knuckles for maintaining manual dexterity of the user's hand in accordance with an additional aspect of the present disclosure.
Figure 4:
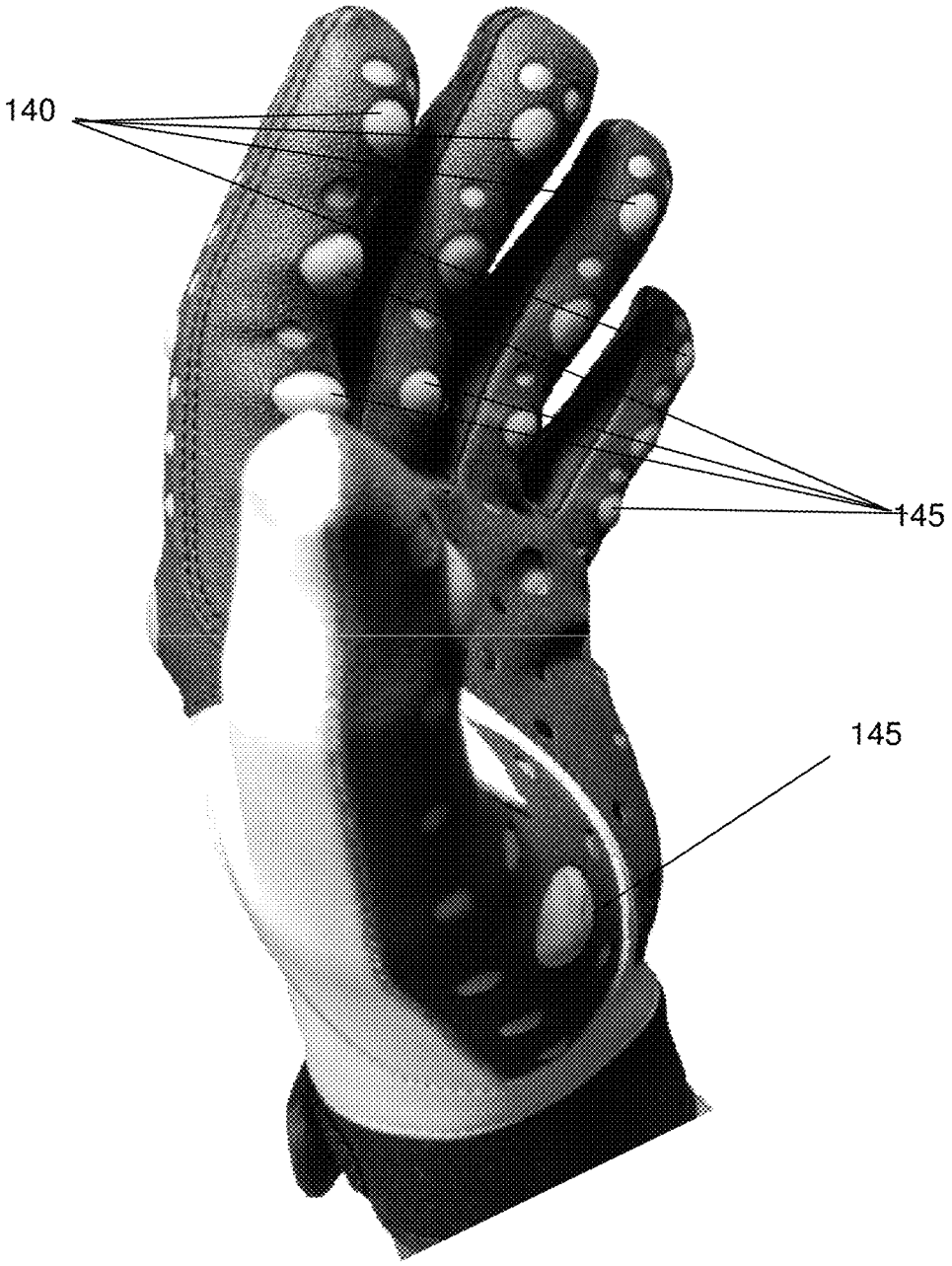
FIG. 4 shows protrusion of the user's natural skin beyond the outer most surface of the conformal glove 100 upon proper sizing in accordance with an additional aspect of the present disclosure.

FIG. 3 shows the glove 100 with holes strategically place on the knuckles for maintaining manual dexterity of the user's hand. These holes will provide increased manual dexterity, respectively. In addition, FIG. 4 shows protrusion of the user's natural skin beyond the outer most surface of the conformal glove 100 upon proper sizing through the medium sized holes 140, e.g., (¼" diameter) and large sized holes 145 (⅜" diameter). This provides increased tactile sensation for the user.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A glove, comprising:

a front side comprising at least a palm area and a backside configured for a backside of a user's hand;

a plurality of independently extending tubular members extending from the palm area, the plurality of independently extending tubular members including four extending tubular members and a thumb member which is an opposing extending tubular member, the four extending tubular members each comprising a tip and a plurality of foldable areas below the tip, and the thumb member comprising a tip and a foldable area therebelow; and a plurality of inter-dispersed holes throughout the backside and the front side, including the independently extending tubular members and the palm area, wherein:

the plurality of inter-dispersed holes include first sized holes, second sized holes and third sized holes;

the first sized holes are larger than the second sized holes and the second sized holes are larger than the third sized holes, each of which are positioned to prevent pass through of a user's fingers during donning and wearing of the glove;

the third sized holes are provided at the tips and the plurality of foldable areas of each of the plurality of independently extending tubular members, on the front side, including at a junction of the plurality of independently extending tubular members and the palm area;

the second sized holes are positioned above an upper most foldable area of the plurality of foldable areas of the four tubular members, directly below the third sized holes provided at the tip of each of the four tubular members; and a first of the first sized holes is positioned above the foldable area of the thumb member and below the third sized holes provided at the tip of the thumb member, wherein the third sized holes are ⅛ inch in diameter, the second sized holes are ¼ inch in diameter, and the first sized holes are ⅜ inch in diameter.

2. The glove of claim 1, wherein additional of the first sized holes are positioned between the third sized holes which are additionally interspersed on the palm area and the junction of the plurality of independently extending tubular members and the palm area.

3. The glove of claim 1, wherein another of the second sized holes is positioned between the third sized holes which are additionally interspersed on the palm area and the junction of the palm area and an end tubular member of the plurality of independently extending tubular members.

4. The glove of claim 1, wherein the second sized holes are positioned between several of the third sized holes each of which are located on the four tubular members.

5. The glove of claim 1, wherein additional of the first sized holes are positioned on the backside below the four tubular members.

6. The glove of claim 5, wherein the additional first sized holes are positioned at foldable areas on the backside below the four tubular members.

7. The glove of claim 1, wherein the front side and the backside are composed of a material that has greater stretchable characteristics in a first direction than in a second direction.

8. The glove of claim 7, wherein the material is a combination of polyester and polyurethane.

9. The glove of claim 8, wherein a ratio of polyester and polyurethane is approximately 60% polyester and 40% polyurethane.

10. The glove of claim 7, wherein the material is anchored to a second material that is less stretchable than the material.

11. The glove of claim 10, wherein the second material is provided at a base of the opposing tubular member, above a wristband, a back portion of the thumb and on the backside below the first sized holes positioned below the four tubular members.

12. The glove of claim 1, wherein an overall thickness of the material in the palm area and the independently extending tubular members is approximately 0.023 inches.

13. The glove of claim 1, further comprising a padding material in the palm area on an opposing side to the opposing tubular member.

14. The glove of claim 1, wherein the plurality of inter-dispersed holes configured for skin exposure on the inside of the glove of approximately 5-30%.

15. A glove comprising a front portion defining a palm area, a rear portion, a plurality of independent tubular members extending from the palm area which includes a central portion and a perimeter portion, and a plurality of inter-dispersed holes provided through at least the central portion of the palm area and the plurality of independent tubular members configured to maximize tactile sensation of a user's hand, increase flexibility and conformity to a user's hand, the plurality of inter-dispersed holes are each circular shaped; and further comprising:

a composite material that exhibits greater stretchable characteristics in a first direction than in a second direction;

a second material which anchors the composite material; and wherein an overall thickness of the glove in the palm area and the plurality of independent tubular members is approximately 0.023 inches:

the plurality of inter-dispersed holes comprise first sized holes, second sized holes and third sized holes, each of which are configured to maximize the tactile sensation of the user's hand;

the plurality of independent tubular members are four finger members and a thumb member, on a front side of each of the four finger members:

a first set, a second set and a third set of the third sized holes are located along a length thereof;

a single second sized hole is provided between the first set and the second set of the third sized holes at a tip portion thereof;

a single first sized hole is provided between the second set and third set of the third sized holes;

the third set of the third sized holes is located below the single first sized hole; and on a front side of the thumb member:

at least two separate sets of the third sized holes are located along a length thereof; and a single first sized hole is located between the at least two separate sets of the third sized holes at an upper portion thereof;

a set of the third sized holes are located at a junction between each of the four finger members and the palm area;

a first sized hole is located in the palm area below each of three finger members of the four finger member;

a second sized hole is located in the palm area below a fourth finger members of the finger members; and a first sized hole is located at a lower portion of each of the finger members between the third set of the third sized holes on the finger members and above each of the third sized holes at the junction.

16. The glove of claim 15, wherein the composite material is composed of polyester and polyurethane in a ratio of approximately 60% polyester and 40% polyurethane.

17. The glove of claim 15, wherein the second material is disposed about a base of a thumb portion of the glove, a backside of the thumb portion and a backside of the glove below the plurality of inter-dispersed holes at a knuckle position.

18. The glove of claim 15, wherein the second material is disposed on a backside of the glove.

19. The glove of claim 18, wherein the second material is a different material type than the composite material.

20. The glove of claim 15, wherein:

the first sized holes have a diameter of ⅜ inch;

the second sized holes have a diameter of ¼ inch; and the third sized holes have a diameter of ⅛ inch.

21. A glove, comprising:

a palm area and a backside opposing the palm area;

a plurality of independently extending tubular members comprising four finger members and an opposing thumb member;

a plurality of first sized holes, second sized holes and third sized holes located throughout the backside, the palm area and the independently extending tubular members;

the first sized holes are larger than the second sized holes and the second sized holes are larger than the third sized holes, each of which are configured to increase the tactile sensation of a user's hand;

on a front side of each of the four finger members:

a first set, second set and third set of the third sized holes are located along a length thereof;

a single second sized hole is located between the first set and the second set of the third sized holes at a tip portion thereof;

a single first sized hole is provided between the second set and third set of the third sized holes; and the third set of the third sized holes is located below the single first sized hole; and on a front side of the thumb member:

at least two separate sets of the third sized holes are located along a length thereof; and a single first sized hole is located between the at least two separate sets of the third sized holes at an upper portion thereof;

a set of the third sized holes are located at a junction between each of the plurality of independently extending tubular members and the palm area;

on the palm area:

a first sized hole is located below each of three finger members of the finger members and the thumb member and a respective set of the third sized holes at the junction;

a second sized hole is located in the palm area below a fourth finger member of the finger members; and a plurality of the third sized holes are located below the first sized holes and the second sized holes in the palm area;

on the backside:

a first sized hole is located at each knuckle of the four finger members;

two second sized holes are located along a length of each of the four finger members; and a plurality of sets of the third sized holes separate the two second sized holes along the length of each of the four finger members.

* * * * *